United States Patent [19]

Spadini et al.

[11] Patent Number: 4,629,332

[45] Date of Patent: Dec. 16, 1986

[54] TIMEPIECE WITH A QUARTZ WATCH MOVEMENT AND AN ELECTRICALLY CONTROLLED SOUND GENERATOR

[75] Inventors: Paolo Spadini, 26, quai Gustave-Ador, CH-1207 Genève; Willy Meier, Fontaines, both of Switzerland

[73] Assignee: Paolo Spadini, Switzerland

[21] Appl. No.: 691,012

[22] Filed: Jan. 14, 1985

[30] Foreign Application Priority Data

Jan. 14, 1984 [CH] Switzerland ..... 162/84

[51] Int. Cl.[4] ..... G04C 21/16

[52] U.S. Cl. ..... 368/252

[58] Field of Search ..... 368/73–74, 368/250, 252

[56] References Cited

U.S. PATENT DOCUMENTS

| | | | |
|---|---|---|---|
| 1,048,987 | 12/1912 | Mauthe | 368/252 |
| 1,459,876 | 6/1923 | Casner | 368/252 |
| 3,611,702 | 10/1971 | Spadini | 368/252 |

FOREIGN PATENT DOCUMENTS

| | | |
|---|---|---|
| 2451563 | 6/1975 | Fed. Rep. of Germany . |
| 2484101 | 6/1980 | France . |
| 8431 | 5/1894 | Switzerland . |
| 9720 | 12/1894 | Switzerland . |
| 13687 | 1/1897 | Switzerland . |
| 537032 | 6/1973 | Switzerland . |
| 541827 | 10/1973 | Switzerland . |

*Primary Examiner*—Vit W. Miska

*Attorney, Agent, or Firm*—Parkhurst & Oliff

[57] ABSTRACT

The operation at the desired time of the sound generator associated with the timepiece having a quartz watch movement is initiated by the closure of a switch. One contact pole of that switch is formed at the end of a helicoidal spring arm made integral with a plane thin washer fixed to the hour wheel of the watch movement. The other contact pole of the switch is formed on a disk coaxially rotatable around the movement axis and has the shape of a radial segment. That disc can manually be set in any angular position around the watch axis. The spring arm permanently presses its end against the disk. During the normal movement run, the spring arm end moves along an insulated area of the disk unit it comes in contact with the radial segment of the disk and closes the switch, thereby initiating the sound generator.

7 Claims, 4 Drawing Figures

TIMEPIECE WITH A QUARTZ WATCH MOVEMENT AND AN ELECTRICALLY CONTROLLED SOUND GENERATOR

BACKGROUND OF THE INVENTION

1. Field of the Invention.

This invention relates to timepieces with a quartz watch movement and an electrically controlled sound generator, more particularly to such movements having sizes adapted to wrist-watches, and to sound generators which can also be used in alarm wrist-watches.

2. Description of the Prior Art.

The manufacturers of quartz watches endeavoured to reduce the current consumption in order to extend the life time of the batteries as much as possible. Thus, with the known movements manufactured nowadays the driving moment of the seconds hand is about three Micronewtonmeters.

To provide a watch with a sound generator which shall become operative at a time adjustable in advance, a switch must in any case be inserted between a member moving in synchronism with the hour hand and another member associated with the indicator displaying the time at which the sound generator will become operative. Some known switches are adapted to fulfil these conditions. With the most frequently used switches, one contact pole of the switch rotates together with the hour hand. That pole is located at the end of a radial spring arm which presses it against the plane surface of a disk made of conducting material and carrying the other contact pole of the switch. That plane surface is insulated except along a radial segment constituting said other contact pole, which is reached by the end of the spring arm when the sound generator has to become operative.

To balance the reaction on the piece, to which the spring arm is anchored, and which is due to the pressure of the spring arm against the disk, that arm is formed on the opposed side of the anchoring point with a tail portion also pressing on the disk, but being shorter than said arm, to avoid contact with the switch pole on the disk.

A spring arm balanced in that way can, however, not be mounted in a quartz watch movement as manufactured nowadays, because its friction against the disk overbalances the driving moment of the hands. Consequently, the watch would stop.

A switch is, however, also known, with which the contact pole rotating together with the hour hand is formed at the end of a spring arm extending along an arc of a circle and pressing that contact pole radially against the cylindrical edge of a collar of insulating material mounted on a metal tube provided with a nose flush with the periphery of the collar to constitute the other contact pole of the switch (Swiss Pat. No. 495,006).

Although the frictional moment due to the pressure exerted by the circular spring arm against the collar, with these known switches, is, as a rule, smaller than that due to the radial arm of the most often used known switches, because the friction point is nearer to the axis of rotation, that frictional moment is still too important for the quartz watch movements manufactured nowadays, since said circular arm is too rigid. It is, indeed, formed by stamping a thin metal sheet and is substantially wider than thick, so that it is bent in a plane parallel to the large side of its cross-section. Thus, a small displacement of its end from its position of rest in a radial direction already produces an important restoring force. Due to the manufacturing tolerances such a switch cannot be produced in series while warranting, on the one hand, a sufficient pressure when the switch is on, and, on the other hand, a moment of friction clearly smaller than the moment driving the hands.

The circular spring arm of the known switches having just been considered could be made more supple by disposing the long side of its cross-section in a direction parallel to the axis of rotation of the hands. Mounting such a spring would, however, excessively increase the cost of the switch.

SUMMARY OF THE INVENTION

The invention primarily aims to equip a timepiece having a quartz watch movement and an electrically controlled sound generator with a switch for the latter being as sure as compatible with the power at disposal with the movements manufactured nowadays.

With the switch according to the invention, the spring arm carrying one contact pole thereof has a helical shape which can easily be produced. It presses its contact pole against the other contact pole, when the switch is on, in an axial direction. That spring arm is stressed all the time, what appears somewhat paradoxical, when one intends to reduce the charge of the battery. However, due to the shape of that spring arm, its permanent pressure against a circular area can be adjusted so as to produce a safe contact, when the switch is on, while avoiding a moment of friction compromising running of the watch, since a relatively important displacement of the spring end in an axial direction only causes a small variation of its pressure, because the spring arm is bent in the direction of its thickness. The manufacturing tolerances have, thus, a quite negligible influence on the watch run. The helical shape of the spring arm has also the advantage that the friction occurs at a place near to the axis of rotation of the switch contact poles. That arrangement does not compromise the precision with which the starting time of the sound generator can be set. Tests shew indeed, that said time can easily be adjusted with a precision of two minutes.

BRIEF DESCRIPTION OF THE DRAWINGS

One embodiment of the timepiece according to the invention is represented diagrammatically and by way of example in the accompanying drawings.

DESCRIPTION OF THE PREFERRED EMBODIMENTS

Figure 1:
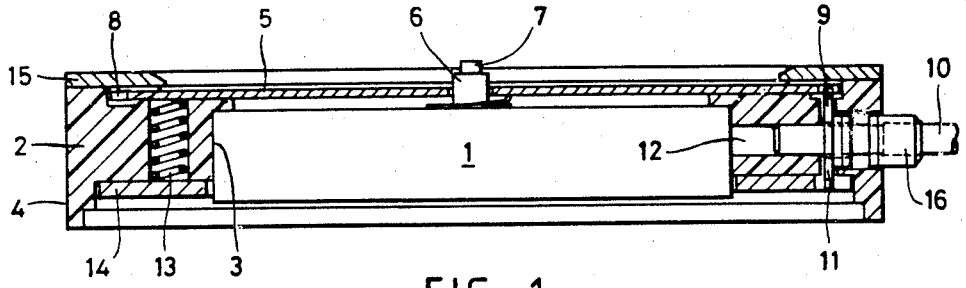
FIG. 1 is a diametrical sectional view of a module comprising a quartz watch movement and a sound generator and being ready to be mounted in the casing of different timepieces.

The module represented in FIG. 1 comprises a standard quartz watch movement 1, i.e. a movement for a conventional watch without any additional device. Movement 1 can be circular or have any other shape. It is mounted in a frame 2 of injected plastic material. Frame 2 is provided with a lodging 3 having a shape adapted to that of movement 1. The outer edge 4 of frame 2 has preferably the form of a circular cylinder.

Instead of a dial plate fixed to movement 1 and hiding the same, the module represented comprises a disk 5 perpendicular to the axis of the watch hands (not shown) and rotatable therearound. The hands are set on sleeves, 6 of an hour wheel, and 7 of a minute wheel of movement 1. The disk 5 is mounted immediately below a dial with the disk 5 having a central tubular projection "T" (as shown in FIG. 5) extending through a dial hole and carrying an alarm indicator "I" thereon. Disk 5 can be driven in rotation by means of a toothing 8 provided at its periphery and meshing with a gear 9 mounted on a setting stem 10. Gear 9 is located in a slot 11 provided across frame 2 and having a length somewhat greater than the diameter of gear 9 so that the latter can freely rotate while being held in a predetermined axial position. Stem 10 is rotary mounted in a radial bore 12 of frame 5. It can be shifted into two different axial positions. In one of said positions a square section of stem 10 lies in a correspondingly shaped opening of gear 9 so as to drive that gear together with the stem. In the other axial position the stem 10 is disconnected from gear 9. Stem 10 thus permits to set the angular position of disk 5 at will.

Disk 5 is made of aluminum. It faces have been submitted to an anodic oxidation. The visible face of disk 5 can thus be colored and receive the same appearance as some plates of conventional dials. Since that oxidation forms an insulating layer, some portions on the reverse side of disk 5 must be masked during the oxidizing step, to take advantage of the conductibility of aluminum. One of those portions has the shape of a circular ring "R" (shown in FIG. 6) and it extends over a zone of disk 5 which permanently remains in contact with a wiper in the form of a coil spring 13, when disk 5 rotates around its axis. Wiper 13 connects disk 5 to one pole of the battery feeding movement 1. Another mask leaves uninsulated a further portion of the reverse side of disk 5. This last portion has the form of a very elongated rectangle, the long side of which is oriented along a radius of disk 5. This portion thus forms a conducting spot which constitutes one of the two contact poles of a switch. A first ring 14 fixed to frame 2 leads current to coil spring 13 and a second ring 15, also fixed to frame 2, carries an horal division, thus serving as dial. Moreover, ring 15 holds disk 5 axially in place. Should the visible face of disk 5 not be insulated and ring 15 be conducting, an insulating gasket would be inserted between these two pieces. An index has been transferred or applied on the visible face of disk 5 and it fulfilLs the office of a hand indicating the time at which the sound generator will start.

The represented module moreover comprises a tube 16 to ensure the tightness of the passage of stem 10. Tube 16 extends through the wall of the timepiece casing (not shown), in which the module is inserted and a conventional watertight crown (not shown) is screwed on the end of stem 10.

Figure 3:
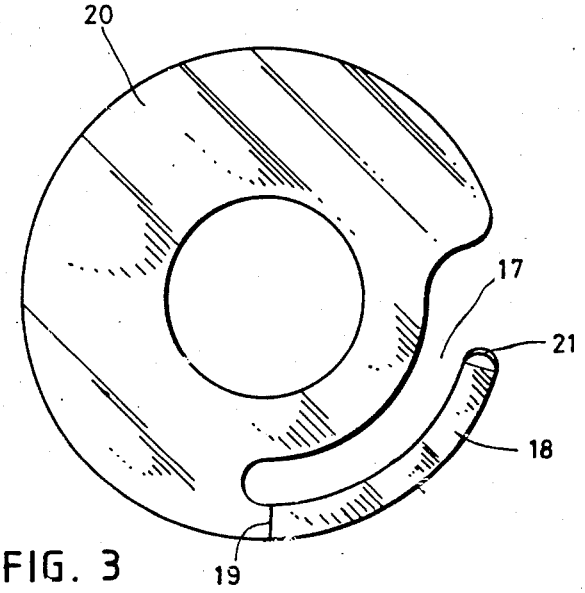
FIG. 3 is a plan view of one part of FIG. 2.
Figure 4:
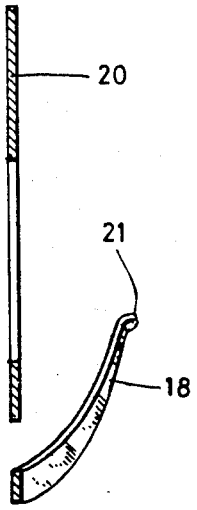
FIG. 4 is a diametrical sectional view of the part of FIG. 3.

The second contact pole of the above-mentioned switch is formed on the piece represented in FIGS. 3 and 4. This piece results from a metallic ring having a thickness of some hundredths of millimeters, in which a peripheral cut-out 17 has been provided so as to form an arm 18. A cranking 19 has been made at the root of arm 18, so that the latter extends out of the plane of body member 20 along a helicoidal surface. The end of arm 18 is rounded and bent away from body member 20 so as to form a projection 21 constituting the second contact pole of the above-mentioned switch.

Figure 2:
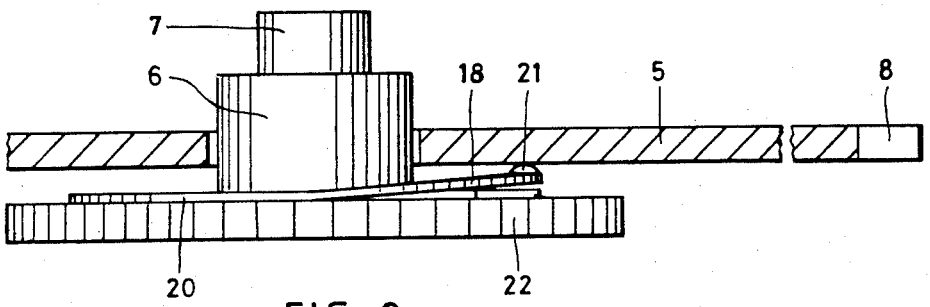
FIG. 2 shows some parts of FIG. 1 on a larger scale.

Body member 20 is fixed onto the hour wheel 22 being integral with sleeve 6 as shown in FIG. 2. This FIG. 2 also shows that nose 21 bears against the reverse side of disk 5. Once the module has been assembled, the distance from body member 20 to nose 21 is about one third of that when arm 18 is at rest. The material of the piece represented in FIGS. 3 and 4 is chosen so that said deformation of arm 18 remains prefectly elastic. Accordingly, arm 18 presses nose 21 against disk 5 with a well determined force. Even if, due to manufacturing tolerances, the distance from disk 5 to wheel 22 is not exactly the same in every point of the path along which wheel 22 moves nose 21 around disk 5, the resulting small variations of the deformation of arm 18 only produce negligible variations of the pressure of nose 21 against disk 5, because of the suppleness of arm 18 in a direction parallel to the movement axis. Accordingly, the bearing force of nose 21 against disk 5 is practically constant.

The contact pole carried by disk 5 is immobile except when manually setting the time at which the second generator shall become operative. During the movement run, nose 21 thus moves along an area of disk 5 having the form of a circular ring. The conducting spot "5" constituting the immobile contact pole of the above-mentioned switch precisely lies in that area.

Once wheel 22 has moved nose 21 in the angular position corresponding to the time indicated by the indicator or alarm hand "I" (shown in FIG. 5) on the visible face of disc 5, nose 21 bears on the contact pole of disk 5 and the above-mentioned switch is on, so that the sound generator starts.

Any known sound generator having the appropriate sizes and qualities can be associated with the circuit including the disclosed switch. Preferably, a sound generator remaining in action during a predetermined time period will be resorted to, the circuit closed by the disclosed switch then only initiating the operation of the sound generator. The sound itself will advantageously be produced by a piezoelectric crystal fixed either to the bottom of the casing containing the module disclosed or to a membrane located in said casing or even to the watch glass, for instance. That sound can be produced by a vibration at a predetermined frequency either continuous or periodically interrupted; it can also consist of a melody or of a speaking voice remainding the hour of an interview, a departure, the absorption of a medicine, etc. All these types of sound generators are well known to those skilled in the art.

With the exception of the disclosed switch and the battery actuating the watch movement, the members controlling the sound generator do not belong to movement 1. These members, which are well known to those skilled in the art, are mounted in lodgings provided in frame 2. The sound generator can accordingly be manufactured separately and mounted on frame 2, which can then receive any conventional watch movement. In addition to the insertion of the movement into such a frame, body member 20 simply need be fixed to wheel 22. This body member and its arm 18 take place in the space which disk 5, being thinner than the conventional dials, leaves free above wheel 22 embedded in movement 1.

The control circuit initiating the sound generator still comprises an interrupter (not shown) which stem 10 opens when it is moved into one of its two axial positions. The sound generator can thus be stopped at will.

Leaving stem 10 in the last mentioned axial position prevents the sound generator from starting.

The sound generators now at disposal have so small a current consumption that they need no independent battery; that of the watch movement is sufficient. The energy dissipated by the sound generator does not noticeably reduce the life time of the movement battery.

The visible face of disk 5 can, of course, be given another appearance as that of anodically oxidized aluminum. Disk 5 could just as well be made of another metal, for instance that of the conventional dials. While terminating then the visible face of disk 5 like that of the conventional dials, its reverse face would be insulated by a lacquer coating. The zone contacting wiper 13 and the conducting spot constituting one pole of the switch should obviously be masked prior to coating the disk reverse face. Finally, metal would have to be vaporized under vacuum over the insulating coating to connect the spot constituting one pole of the switch to the zone in contact with wiper 13. Due to the increased thickness of such a disk, sleeves 6 and 7 longer than the standards could be necessary.

The disk carrying the spot constituting one contact pole of the disclosed switch need not replace the dial; it could also be mounted under a conventional dial. The disk would then have to be made integral with a sleeve extending through the dial central opening and a hand should be set on this sleeve. In this case, sleeves 6 and 7 should be longer than the standards.

The contact poles of the switch disclosed must not necessarily rotate coaxially with the watch hands; it suffices to provide them on a pair of coaxially rotating members, one of which rotating together with the hour wheel and the other one being cinematically connected to the indicator member "I" indicating the time at which the sound generator will be initiated. It is also not necessary that nose 21 rotates together with the watch hands; it could just as well constitute the adjustable fixed contact pole. The disk carrying the other contact pole of the switch would then have to be driven in synchronism with the watch hands.

Finally, the utilization of the module represented in FIG. 1 is not limited to wrist-watches. It could just as well be used in miniature alarm clocks or in pocket transistors for switching them on at the desired time.

In all the evoked cases, the moment of friction exerted on wheel 22 by nose 21 is weak enough to avoid the risk of stopping the movement 1. That is due, on the one hand, to the suppleness of arm 18 which is bent in a direction parallel to the small side of its cross-section, and, on the other hand, to the fact that nose 21 is near to its axis of rotation, so that the lever arm of the force of friction of nose 21 on disk 5 is reduced. The helicoidal shape of arm 18 has the advantage that nose 21 is pulled over the asperities of disk 5 as for instance those possibly constituted by the edges of the conducting spot "5" without increasing the moment of friction exerted on the wheel carrying it. In contradistinction thereto, the radial arms of the known switches, which encounter some asperity along their path, butt thereagainst and are accordingly submitted to a strain bending them not only in a direction parallel to the small side of their cross-section, but also in a direction parallel to the long side thereof, thereby causing a sudden increase of the moment of friction to an important extent. The configuration of nose 21 has also the advantage to scrape off the oxidized parts which could appear for instance on the contact pole of disk 5.

We claim:

1. A timepiece with a quartz watch movement and an electrically controlled sound generator comprising:

an analogous time display means including a dial and an hour hand;

an electrical circuit for energizing the sound generator;

a switch arranged to close said electrical circuit at a predetermined time;

an indicator displaying on said dial a time at which said switch will close said circuit, said switch including a first contact pole being rotatably driven about a fixed axis at the same speed as said hour hand;

and a second contact pole rotatable about said fixed axis in synchronism with said indicator and being manually adjustable to any predetermined angular position around said fixed axis, one of said two contact poles consisting of a spot formed in an insulating area having a plane circular ring shape and being perpendicular to and coaxial with said fixed axis, a second one of said two contact poles being formed at an end of a helicoidal spring arm, thereby permanently pressing said second contact pole in a direction parallel to said fixed axis against said insulating area with a substantially constant force.

2. A timepiece according to claim 1, wherein said insulating area consists essentially of an insulating layer coated on one face of a disc of electrically conducting material, said layer leaving said disk naked at a place having the shape of a narrow radial segment, thereby forming said spot.

3. A timepiece according to claim 2, wherein said spot is electrically connected to an annular naked zone of said disk, a wiper being permanently in contact with said zone.

4. A timepiece according to claim 1, wherein said helicoidal spring arm is partially detached from a plane thin washer by a peripheral cut-out of said washer and is cranked out of the plane of said washer.

5. A timepiece according to claim 3, wherein said two poles are formed on rotatable members being coaxial with said hour hand, said disk being mounted immediately below said dial and having a central tubular projection extending through a dial hole and carrying an alarm hand constituting said indicator.

6. A timepiece according to claim 3, wherein said disk forms part of the visible watch face and carries an index comprising said indicator.

7. A timepiece according to claim 6, wherein said disk comprises aluminum, said insulating area being formed by anodic oxidation.

* * * * *